US012799943B2

(12) United States Patent
Wan et al.

(10) Patent No.: US 12,799,943 B2
(45) Date of Patent: Nov. 17, 2026

(54) POND WATER PUMP

(71) Applicant: Shenzhen Haike Plastic Electronics Co., Ltd., Shenzhen (CN)

(72) Inventors: Gangbin Wan, Shenzhen (CN); Jianliang Xiong, Shenzhen (CN)

(73) Assignee: Shenzhen Haike Plastic Electronics Co., Ltd., Shenzhen (CN)

( * ) Notice: Subject to any disclaimer, the term of this patent is extended or adjusted under 35 U.S.C. 154(b) by 343 days.

(21) Appl. No.: 18/619,328

(22) Filed: Mar. 28, 2024

(65) Prior Publication Data

US 2025/0297612 A1 Sep. 25, 2025

(30) Foreign Application Priority Data

Mar. 22, 2024 (CN) ..... 202420568565.9

(51) Int. Cl.
*F04D 13/08* (2006.01)
*F04D 29/40* (2006.01)
*F04D 29/60* (2006.01)

(52) U.S. Cl.
CPC ..... *F04D 13/08* (2013.01); *F04D 29/406* (2013.01); *F04D 29/605* (2013.01)

(58) Field of Classification Search
None
See application file for complete search history.

(56) References Cited

U.S. PATENT DOCUMENTS

2012/0230852 A1* 9/2012 Andresen ..... F04D 15/0218 417/422
2021/0108641 A1* 4/2021 Arkwright ..... F04D 29/605
2024/0167479 A1* 5/2024 Liang ..... F04D 29/426

* cited by examiner

*Primary Examiner* — Richard C Gurtowski

(57) ABSTRACT

The present disclosure provides a pond water pump. The pond water pump includes a driving device, a filtering mesh, and a light-emitting device. The light-emitting device and the driving device are both arranged in the filtering mesh. The light-emitting device is electrically connected to the driving device. The light-emitting device is arranged in a filtering mesh. The light-emitting device is electrically connected to the driving device. When the driving device is turned on, the light-emitting device can emit light. Therefore, even if a user uses the pond water pump at night, a situation inside the pond and a situation of the pond water pump can also be observed. A material of the housing is transparent polyvinyl chloride, so that the housing is waterproof, which protects a lamp body. It is also convenient to assemble the housing on the mounting rack, and a light-emitting main body is also more attractive.

15 Claims, 5 Drawing Sheets

POND WATER PUMP

CROSS-REFERENCE TO RELATED APPLICATIONS

The application claims priority of Chinese patent application CN202420568565.9, filed on Mar. 22, 2024, which is incorporated herein by reference in its entireties.

TECHNICAL FIELD

The present disclosure relates to a water pump, and in particular, to a pond water pump, which is applied to the technical field of water pump equipment.

BACKGROUND

A current water pump refers to a pump that has an air (water) suction nozzle for entering and an air (water) discharging nozzle for exiting. Furthermore, a vacuum or negative pressure can be continuously formed at an inlet.

A pond water pump can help water circulation, prevent deposition of dirt in water, and maintain clear and fresh water. The pond water pump can be used in swimming pools to mainly circulate and filter pool water. The pond water pump can filter and purify the pool water through a filter and keep the pool water clear and clean. The pond water pump can also be used in ponds. The pond water pump is used to continuously suck water from a pond and return the water back into the pond, so that nutrients in the water are uniformly flipped, which avoids dead water zones in the water and maintains the ecological balance of the pond. However, the pond water pumps on the market are inconvenient to use at night and have relatively single functions, making it difficult to observe pumping states of the water pumps, such as an underwater condition. Or, the water pumps may suck other important objects during pumping, so that the existing water pumps need to be provided with external equipment. For example, an additional lamp needs to be used to observe the water pumping situation of the water pump.

SUMMARY

For the above-mentioned problem that the pond water pumps in the prior art are inconvenient to use at night and have relatively single functions, making it difficult to observe water pumping states of the water pumps, the present disclosure provides a pond water pump. The light-emitting device is arranged in a filtering mesh; the light-emitting device is electrically connected to the driving device; and when the driving device is turned on, the light-emitting device can emit light. Therefore, even if a user uses the pond water pump at night, a situation inside the pond and a situation of the pond water pump can also be observed.

The technical solution adopted by the present disclosure to solve the technical problem is as follows.

A pond water pump, wherein the pond water pump includes a driving device, a filtering mesh, and a light-emitting device; the light-emitting device and the driving device are both arranged in the filtering mesh; and the light-emitting device is electrically connected to the driving device.

Further, a top of the filtering mesh is provided with a first mounting groove; the driving device is mounted in the first mounting groove; and the light-emitting device is located at a bottom of the first mounting groove.

Further, the light-emitting device includes a mounting rack and a light-emitting main body; the mounting rack is arranged on the filtering mesh; and the light-emitting main body is mounted on the mounting rack.

Further, the mounting rack is an annular bracket; a second mounting groove is arranged on an outer side wall of the mounting rack; the mounting rack sleeves an outer side wall of the first mounting groove; and the light-emitting main body is arranged in the second mounting groove.

Further, there is more than one clamping block arranged on an inner side wall of the mounting rack; insertion ports are arranged at a periphery of a side wall of the first mounting groove; and when the mounting rack is mounted on the filtering mesh, the clamping blocks are clamped in the insertion ports.

Further, the mounting rack includes an upper mounting part and a lower mounting part; the upper mounting part and the lower mounting part can be spliced and connected; and when the upper mounting part and the lower mounting part are spliced, the second mounting groove is formed.

Further, the clamping blocks include a first clamping block and a second clamping block; the first clamping block is arranged on an inner side surface of the upper mounting part, and the second clamping block is arranged on an inner side surface of the lower mounting part; the first clamping block is provided with an insertion pin, and the second clamping block is provided with a jack; and when the upper mounting part and the lower mounting part are mounted, the insertion pin is inserted into the jack.

Further, the light-emitting main body includes a lamp body and a housing; the lamp body is arranged in the housing; light of the lamp body is transmitted through the housing; and the housing seals the lamp body.

Further, a material of the housing is transparent polyvinyl chloride.

Further, the lamp body includes a flexible circuit board and a light-emitting diode (LED) lamp; and the LED lamp is arranged on the flexible circuit board and is electrically connected to the flexible circuit board.

Further, the pond water pump further includes an electric wire; a first threading hole is arranged on the filtering mesh; a second threading hole is arranged on the mounting rack; a third threading hole is arranged on the housing; one end of the electric wire is connected to the driving device, and the other end of the electric wire is connected to the lamp body through the first threading hole, the second threading hole, and the third threading hole in sequence; the third threading hole is connected to the electric wire through interference fit; and the electric wire is connected to the first threading hole through interference fit.

Further, the filtering mesh includes a filtering mesh main body and a wire passing cover; the filtering mesh main body is provided with a mounting port; the wire passing cover is detachably arranged at the mounting port; and the first threading hole is arranged on the wire passing cover.

Further, first water baffle plates are arranged between the filtering mesh and a side wall of the first mounting groove; and the first water baffle plates are located on two sides of the first threading hole.

Further, second water baffle plates are further arranged between the filtering mesh and the side wall of the first mounting groove; and the second water baffle plates are located on a side opposite to the first water baffle plates.

Further, a ring groove is arranged on an outer side wall of the driving device; the ring groove is arranged around the outer side wall of the driving device; a convex block is arranged at a periphery of an inner side wall of the first mounting groove; the convex block is clamped into the ring groove, so that the driving device is connected to the filtering mesh.

Further, a bottom of the first mounting groove is provided with several first through holes, and a side wall of the first mounting groove is provided with several second through holes.

Further, an outer side wall of the filtering mesh is provided with several third through holes, and the third through holes extend from a top edge of the filtering mesh to a bottom edge of the filtering mesh.

The present disclosure has the beneficial effects: The present disclosure provides a pond water pump. The light-emitting device is arranged in a filtering mesh; the light-emitting device is electrically connected to the driving device; and when the driving device is turned on, the light-emitting device can emit light. Therefore, even if a user uses the pond water pump at night, a situation inside the pond and a situation of the pond water pump can also be observed. A material of the housing is transparent polyvinyl chloride, so that the housing is waterproof, which protects a lamp body. It is also convenient to assemble the housing on the mounting rack, and a light-emitting main body is also more attractive.

DETAILED DESCRIPTION OF THE EMBODIMENTS

In order to make the aims, technical solution and advantages of the present disclosure will be clearly, the present disclosure is further described below in combination with accompanying drawings and implementations. It should be understood that the specific embodiments described herein are intended only to explain the present disclosure and are not intended to define the present disclosure.

Figure 1:
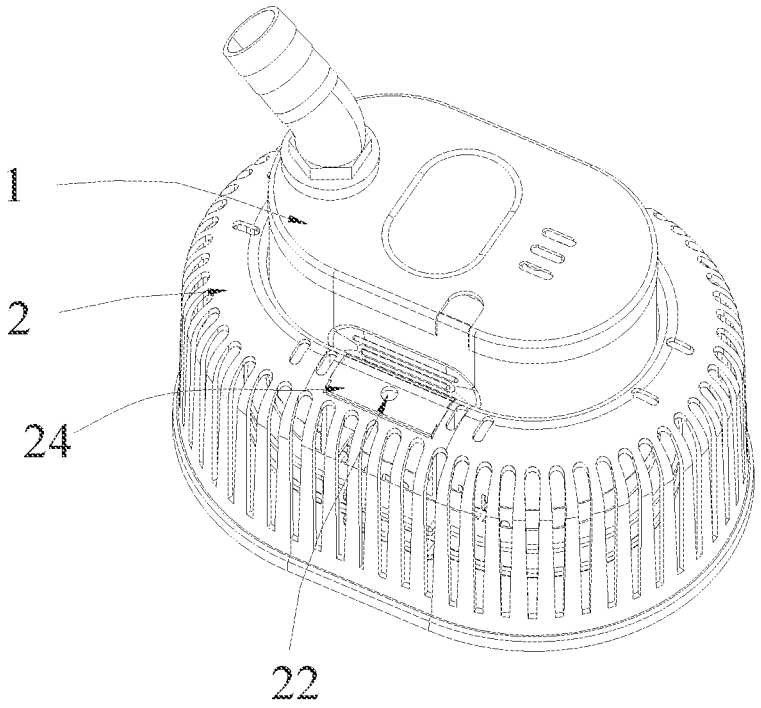
FIG. 1 is a three-dimensional diagram of a pond water pump according to the present disclosure.
Figure 2:
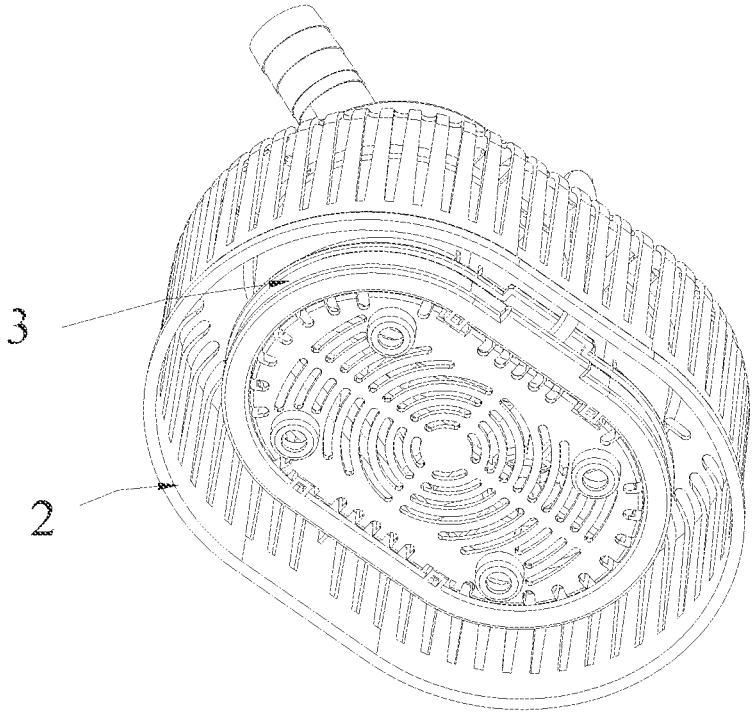
FIG. 2 is a three-dimensional diagram of another viewing angle of FIG. 1 according to the present disclosure.

Referring to FIG. 1 to FIG. 8, the present disclosure provides a pond water pump. It is inconvenient for a user to use the existing pond water pump at night, and a water pumping state cannot be observed, so that it is in urgent need for a pond water pump to solve the above problems. As shown in FIG. 1 to FIG. 2, the pond water pump in this embodiment includes a driving device 1, a filtering mesh 2, and a light-emitting device 3; the light-emitting device 3 and the driving device 1 are both arranged in the filtering mesh 2; and the light-emitting device 3 is electrically connected to the driving device 1. By the arrangement of the light-emitting device, a user can observe a water pumping state at night when using the water pump. That is, when the driving device is turned on, the light-emitting device can emit light. Therefore, even if the user uses the pond water pump at night, a situation inside a pond and a situation of the pond water pump can also be observed. The filtering mesh can be made of a plastic material or another metal material. However, the filtering mesh in this embodiment is made of the plastic material, which reduces the overall weight of the pond water pump and also reduces the manufacturing cost of the pond water pump.

The light emitted by the light-emitting device in this embodiment can be monochromatic light, such as pure white light, or can be dazzling light mixed with various colors. The light emitted by the light-emitting device in this embodiment is preferably white light. The white light can more clearly distinguish the situation in the pond and the situation around the filtering mesh.

Figure 7:
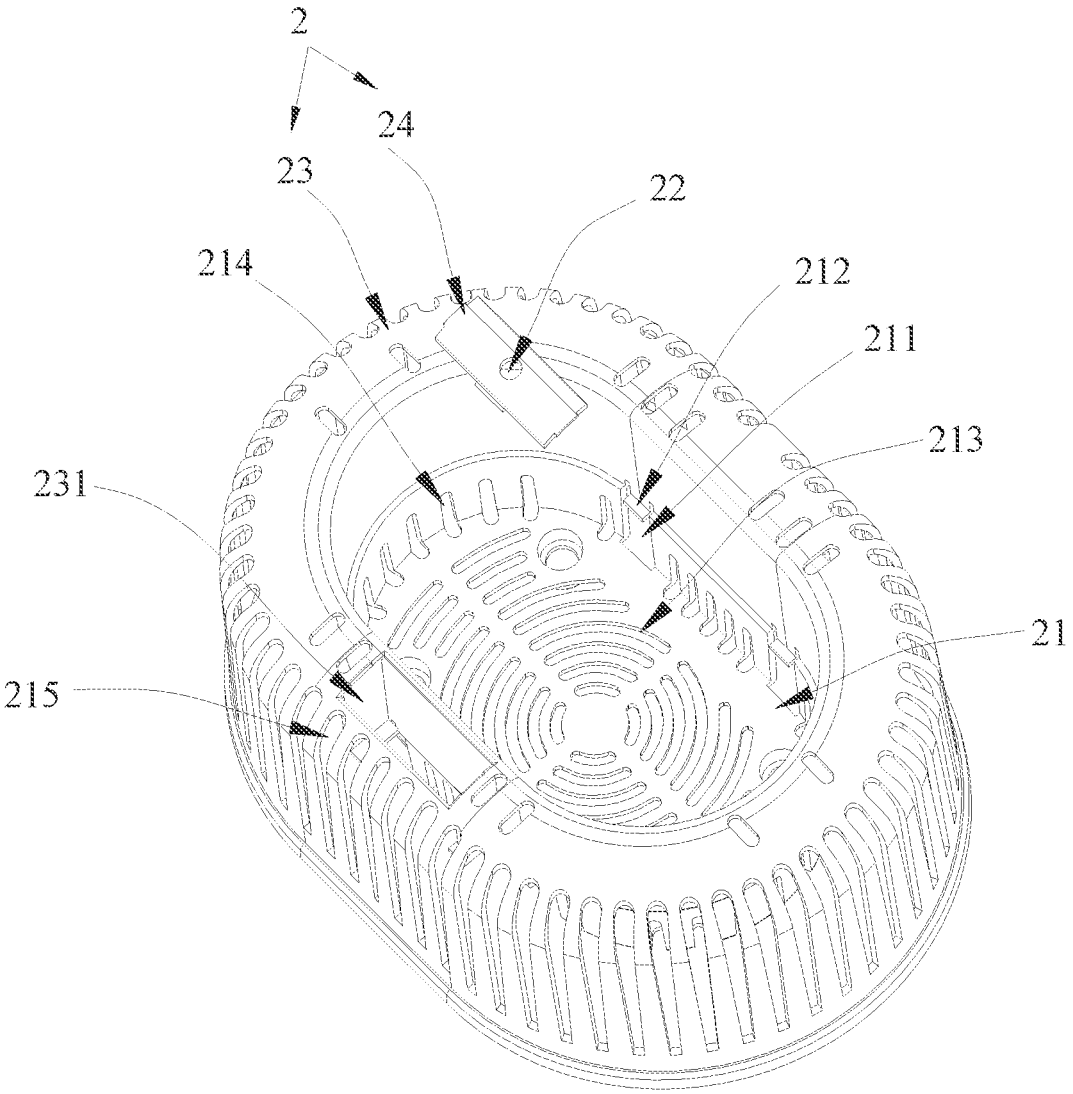
FIG. 7 is a three-dimensional diagram of a filtering mesh according to the present disclosure.

In this embodiment, as shown in FIG. 1 and FIG. 7, a top of the filtering mesh 2 is provided with a first mounting groove 21; the driving device 1 is mounted in the first mounting groove 21; and the light-emitting device 3 is located at a bottom of the first mounting groove 21. This structure facilitates the mounting of the driving device. The light-emitting device is arranged at the bottom of the driving device, so that the light of the light-emitting device can irradiate the bottom of the pond and the filtering mesh, making it convenient for the user to observe the situation inside the pond or around the filtering mesh. In this embodiment, the light-emitting device is arranged on an outer side wall of the first mounting groove, so that the light is less blocked. If the light-emitting device is arranged in the first mounting groove, the light will be more blocked and is relatively weak. If the light-emitting device is arranged on an outer side wall of the filtering mesh, it is difficult to plan wiring of an electric wire, and the wire may be damaged in a water pumping process of the pond water pump. In this embodiment, the arrangement position of the light-emitting device will not be limited, but it is preferred that the light-emitting device is arranged on the outer side wall of the first mounting groove.

Figure 3:
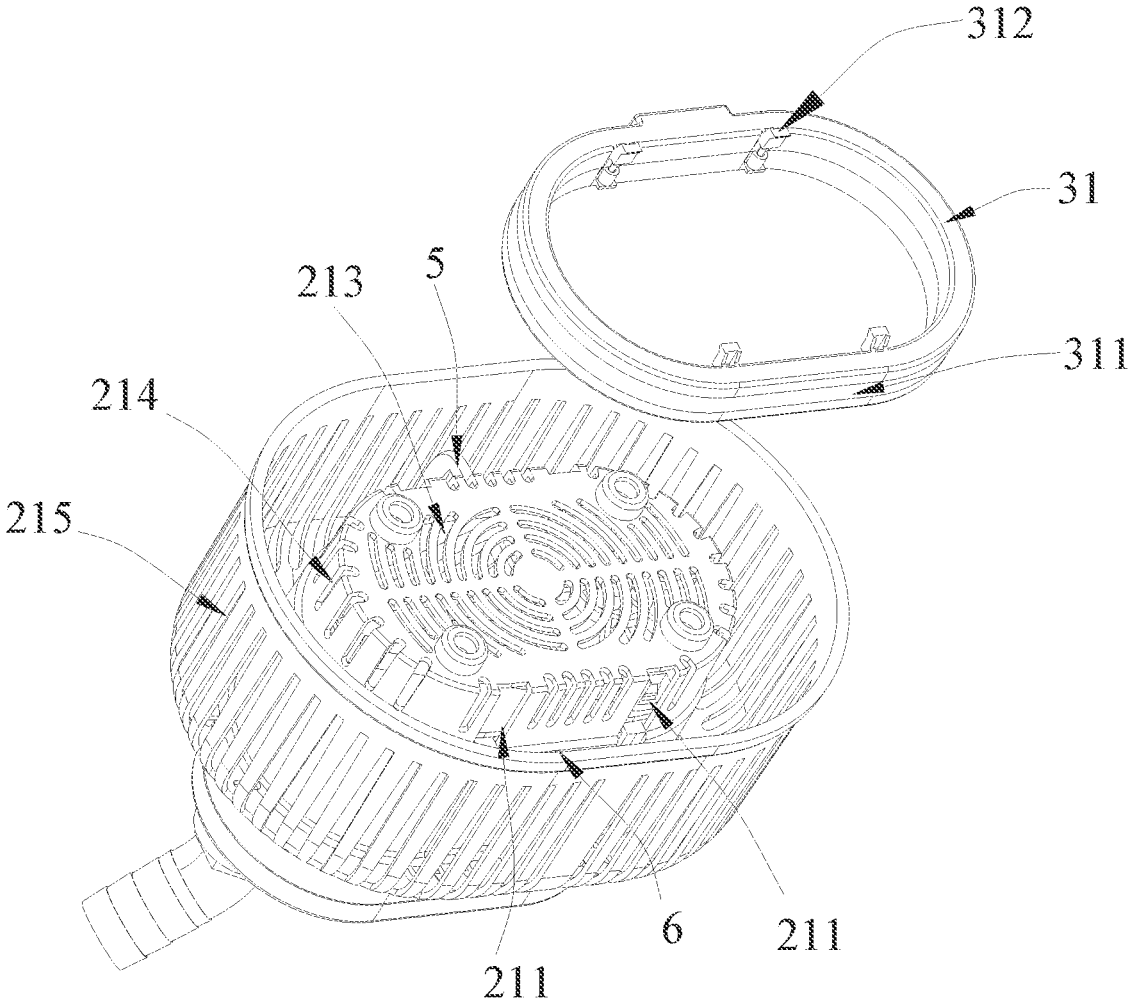
FIG. 3 is an exploded diagram of a pond water pump according to the present disclosure.

In this embodiment, as shown in FIG. 3, the light-emitting device 3 includes a mounting rack 31 and a light-emitting main body 32; the mounting rack 31 is arranged on the filtering mesh 2; and the light-emitting main body 32 is mounted on the mounting rack 31. The use of the mounting rack is more convenient for the mounting of the light-emitting main body.

Figure 4:
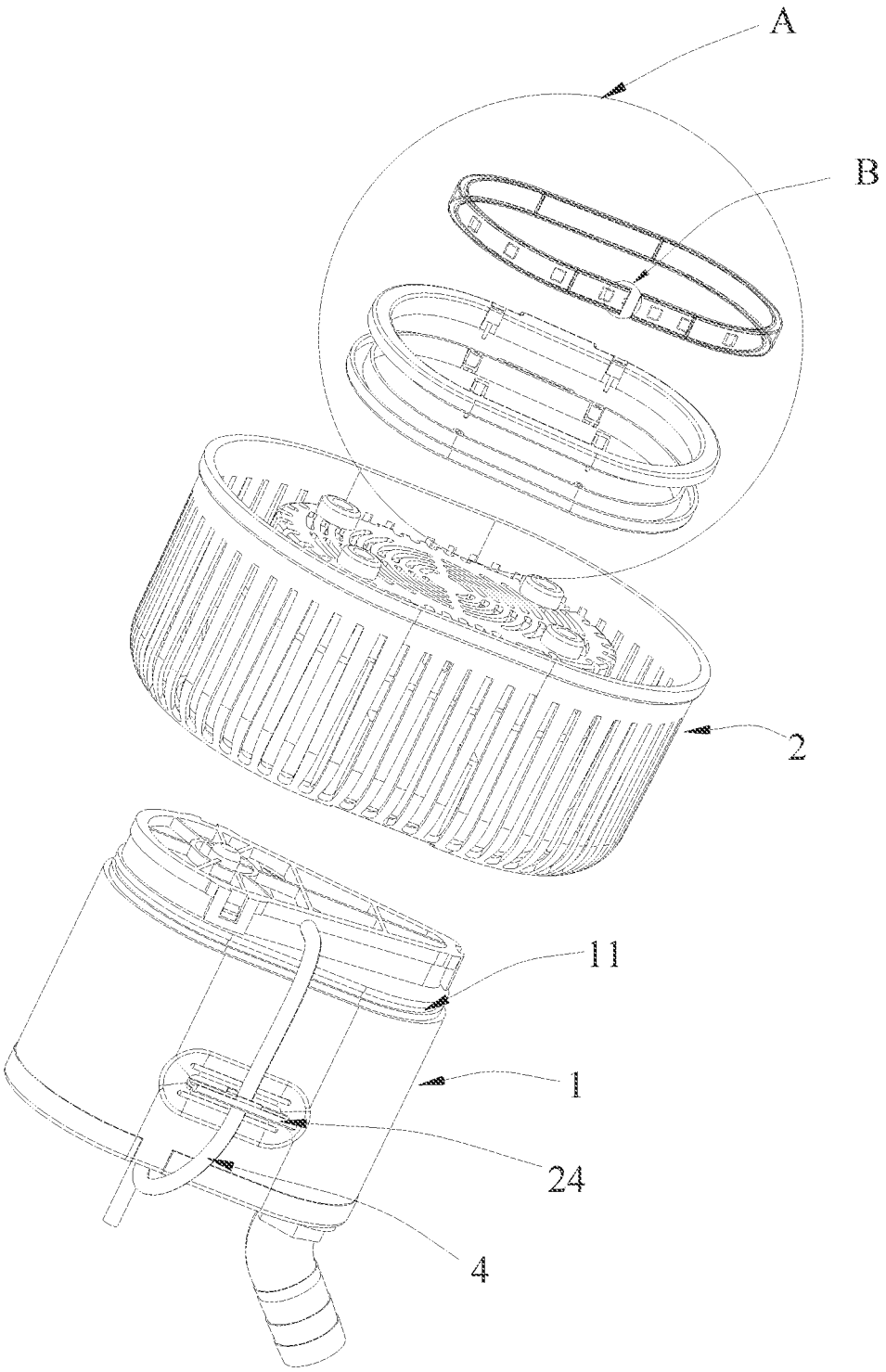
FIG. 4 is a further exploded diagram of FIG. 3 according to the present disclosure.
Figure 5:
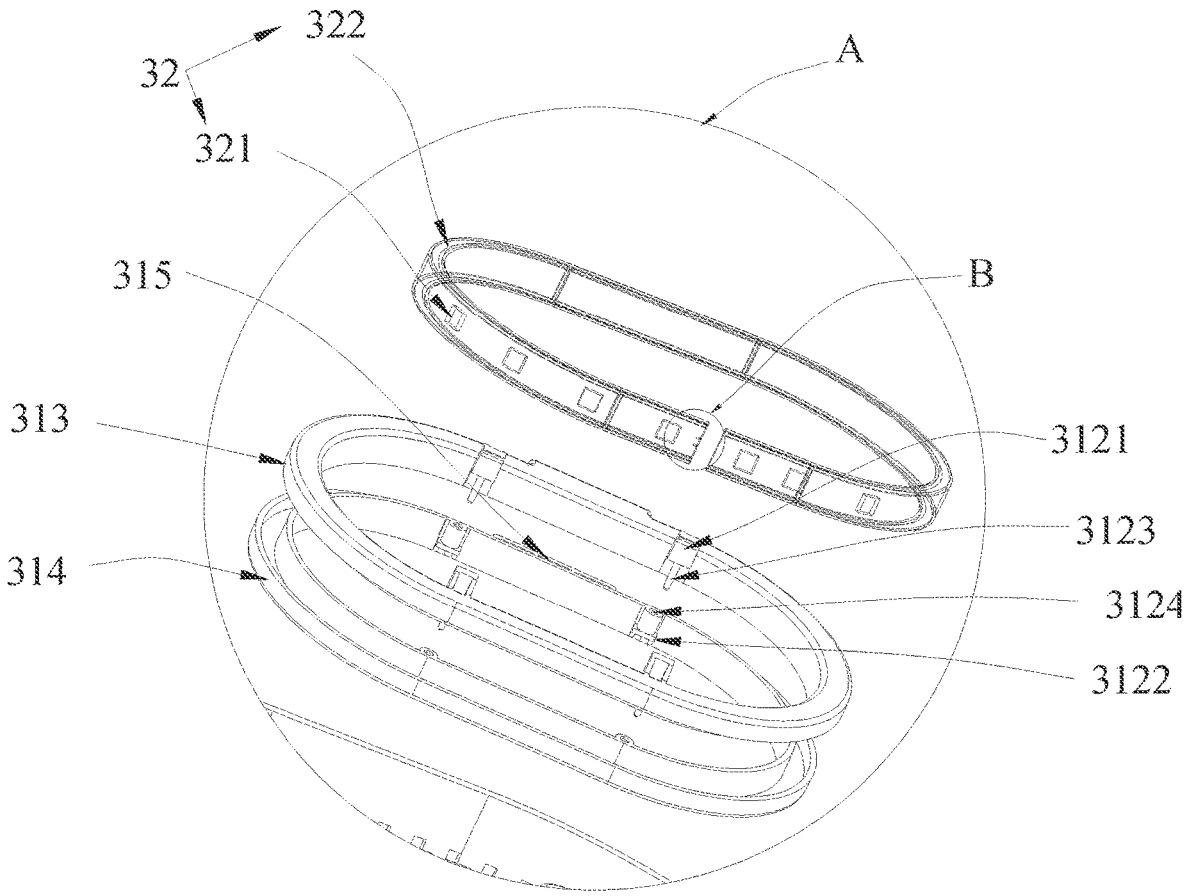
FIG. 5 is an enlarged view of part A in FIG. 4 according to the present disclosure.
Figure 6:
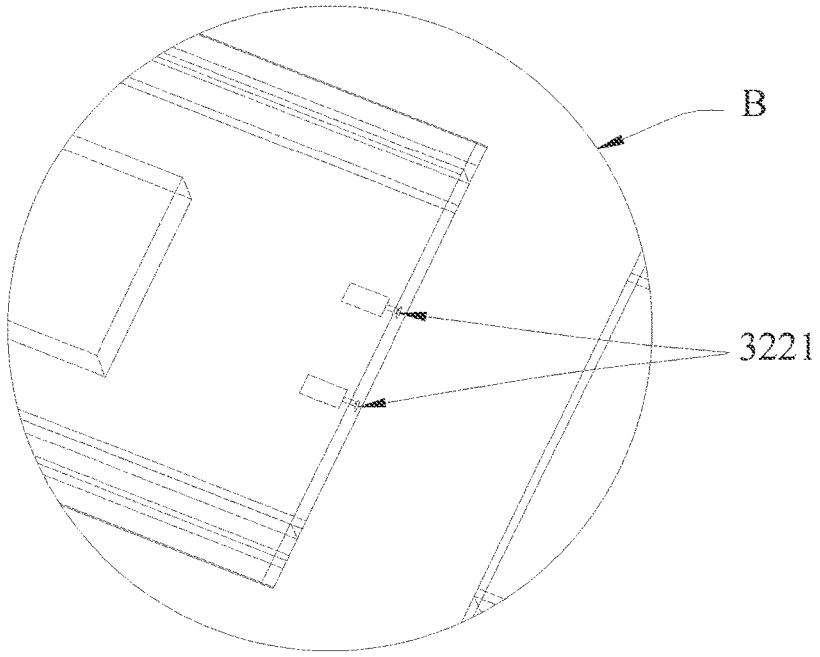
FIG. 6 is an enlarged view of part B in FIG. 4 according to the present disclosure.

In this embodiment, as shown in FIG. 3 to FIG. 5, the mounting rack 31 is an annular bracket; a second mounting groove 311 is arranged on an outer side wall of the mounting rack 31; the mounting rack 31 sleeves an outer side wall of the first mounting groove 21; and the light-emitting main body 32 is arranged in the second mounting groove 311. The second mounting groove here is arranged around the outer side wall of the annular bracket. The light-emitting main body can be arranged along the second mounting groove. A plurality of light-emitting main bodies or one light-emitting main body can be provided. As the assembling cost of the plurality of light-emitting main bodies is high, and the assembling time is long, one light-emitting main body is preferred in this embodiment, and a flexible circuit board and an outer shell made of a flexible transparent material is used. The outer shell made of the flexible transparent material includes the flexible circuit board. The flexible circuit board is provided with a plurality of parallel light-emitting diode (LED) lamps, that is, light of the light-emitting main body can be dispersed around the filtering mesh, and it is convenient for the user to observe the situation around the filtering mesh and also convenient for the user to observe the situation at the bottom of the pond. Therefore, the user does not need to use external light source equipment to observe the pond or the pond water pump. This brings convenience for the user.

In this embodiment, as shown in FIG. 3 to FIG. 5, there is more than one clamping block 312 arranged on an inner side wall of the mounting rack 31; insertion ports 211 are arranged at a periphery of a side wall of the first mounting groove 21; and when the mounting rack 31 is mounted on the filtering mesh 2, the clamping blocks 312 are clamped in the insertion ports 211. This structure facilitates cooperation and connection between the mounting rack and the filtering mesh. The clamping manner is more convenient and simpler than bolting. The clamping manner saves the cost and shortens the assembling time.

In this embodiment, as shown in FIG. 5, the mounting rack 31 includes an upper mounting part 313 and a lower mounting part 314; the upper mounting part 313 and the lower mounting part 314 can be spliced and connected; and when the upper mounting part 313 and the lower mounting part 314 are spliced, the second mounting groove 311 is formed. By the arrangement of the upper mounting part 313 and the lower mounting part 314, it is convenient to mount and assemble the mounting rack. If the upper mounting part and the lower mounting part are not separately arranged, it is hard to assemble the mounting rack to the filtering mesh.

In this embodiment, the clamping blocks 312 include a first clamping block 3121 and a second clamping block 3122; the first clamping block 3121 is arranged on an inner side surface of the upper mounting part 313, and the second clamping block 3122 is arranged on an inner side surface of the lower mounting part 314; the first clamping block 3121 is provided with an insertion pin 3123, and the second clamping block 3122 is provided with a jack 3124; and when the upper mounting part 313 and the lower mounting part 314 are mounted, the insertion pin 3123 is inserted into the jack 3124. It should be noted that during the mounting of the upper mounting part and the lower mounting part, the upper mounting part is first mounted, and the lower mounting part is then mounted. In this way, the insertion pin can be inserted into the jack, which facilitates the assembling of the mounting rack. In addition, this mounting structure makes the connection between the upper mounting part and the lower mounting part more stable and prevents damage to the mounting rack due to an impact force of water.

In this way, as shown in FIG. 5, the light-emitting main body 32 includes a lamp body 321 and a light-transmittance housing 322; the lamp body 321 is arranged in the housing 322; and the housing 322 seals the lamp body 321 to achieve a waterproof effect and protect the lamp body. In this embodiment, the light-transmittance housing preferably uses a white transparent material, so that the light transmittance performance is better, and the situation in the pond and the situation around the filtering mesh can be observed more clearly.

Figure 8:
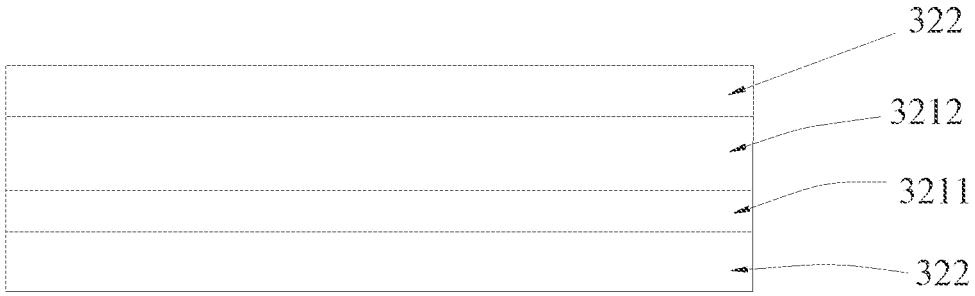
FIG. 8 is a cross-sectional view of a lamp body according to the present disclosure.

In this embodiment, as shown in FIG. 5 and FIG. 8, the lamp body 321 includes a flexible circuit board 3211 and an LED lamp 3212; and the LED lamp 3212 is arranged on the flexible circuit board 3211 and is electrically connected to the flexible circuit board 3211. A material of the housing 322 is transparent polyvinyl chloride (PVC). The transparent PVC in this embodiment is soft and transparent, which is convenient for arranging the light-emitting main body around the second mounting groove and assembling the light-emitting main body. The light-emitting main body in this embodiment cannot be ringlike, but in a straight bar shape. The transparent PVC in this embodiment is soft and transparent, which can be arranged around the second mounting groove, so that the assembling time is saved. The PVC has low cost and high plasticity, so that the cost is reduced, and the stability of usage of the product is guaranteed.

In this embodiment, as shown in FIG. 4, the pond water pump further includes an electric wire 4; a first threading hole 22 is arranged on the filtering mesh 2; a second threading hole 315 is arranged on the mounting rack 31; a third threading hole 3221 is arranged on the housing 322; one end of the electric wire 4 is connected to the driving device 1, and the other end of the electric wire 4 is connected to the lamp body 321 through the first threading hole 22, the second threading hole 315, and the third threading hole 3221 in sequence; and the third threading hole 3221 and the first threading hole are both connected to the electric wire 4 through interference fit. This structure better protects the connection between the electric wire and the lamp body, so as to prevent damage to the electric wire due to an impact force of a water flow during the running of the pond water pump.

In this embodiment, as shown in FIG. 7, the filtering mesh 2 includes a filtering mesh main body 23 and a wire passing cover 24; the filtering mesh main body 23 is provided with a mounting port 231; the wire passing cover 24 is detachably arranged at the mounting port 231; and the first threading hole 22 is arranged on the wire passing cover 24. By the arrangement of the wire passing cover, it is more convenient for the mounting of the electric wire. Since the filtering mesh in this embodiment is made of the plastic material, if the first threading hole is directly arranged on the filtering mesh, the filtering mesh will be damaged by a high force in the threading process of the electric wire. By the separate arrangement of the wire passing cover, the wire passing cover is small in volume and hard to damage.

In this embodiment, as shown in FIG. 3, first water baffle plates 5 are arranged between the filtering mesh 2 and a side wall of the first mounting groove 21; and the first water baffle plates 5 are located on two sides of the first threading hole 22, so as to prevent the damage to the electric wire due to the impact force of the water. When the first threading hole is arranged on the wire passing cover, the first water baffle plates are arranged on the two sides of the mounting port to reduce the impact force of the water flow passing through the wire passing cover and to protect the wire passing cover.

In this embodiment, as shown in FIG. 3, second water baffle plates 6 are further arranged between the filtering mesh 2 and the side wall of the first mounting groove 21; and the second water baffle plates 6 are located on a side opposite to the first water baffle plates 5 to divide the water.

In this embodiment, a ring groove 11 is arranged on an outer side wall of the driving device 1; the ring groove 11 is arranged around the outer side wall of the driving device 1; a convex block 212 is arranged at a periphery of an inner side wall of the first mounting groove 21; the convex block 212 is clamped into the ring groove 11, so that the driving device 1 is connected to the filtering mesh 2. This structure is more stable in clamping and more convenient for connection.

In this embodiment, as shown in FIG. 3 and FIG. 7, a bottom of the first mounting groove 21 is provided with several first through holes 213, and a side wall of the first mounting groove 21 is provided with several second through holes 214. In this embodiment, the several first through holes are uniformly distributed at the bottom of the first mounting groove, and the several second through holes are uniformly distributed on the side wall of the first mounting groove.

In this embodiment, as shown in FIG. 3 and FIG. 7, an outer side wall of the filtering mesh 2 is provided with several third through holes 215, and the third through holes 215 extend from a top edge of the filtering mesh 2 to a bottom edge of the filtering mesh 2.

In summary, the pond water pump in this embodiment solves the problem of inconvenience in use at night. Furthermore, the pond water pump in this embodiment is simple in structure, convenient to assemble, and high in stability.

It should be understood that the application of the present disclosure is not limited to the embodiments mentioned above. Those of ordinary skill in the art can obtain improvements or modifications based on the above descriptions. All such improvements and modifications should fall within the scope of protection of the claims of the present disclosure.

What is claimed is:

1. A pond water pump, wherein the pond water pump comprises a driving device, a filtering mesh, and a light-emitting device; the light-emitting device and the driving device are both arranged in the filtering mesh; and the light-emitting device is electrically connected to the driving device;

wherein a top of the filtering mesh is provided with a first mounting groove; the driving device is mounted in the first mounting groove; and the light-emitting device is located at a bottom of the first mounting groove;

wherein the light-emitting device comprises a mounting rack and a light-emitting main body; the mounting rack is arranged on the filtering mesh; and the light-emitting main body is mounted on the mounting rack.

2. The pond water pump according to claim 1, wherein the mounting rack is an annular bracket; a second mounting groove is arranged on an outer side wall of the mounting rack; the mounting rack sleeves an outer side wall of the first mounting groove; and the light-emitting main body is arranged in the second mounting groove.

3. The pond water pump according to claim 2, wherein there is more than one clamping block arranged on an inner side wall of the mounting rack; insertion ports are arranged at a periphery of a side wall of the first mounting groove; and when the mounting rack is mounted on the filtering mesh, the clamping blocks are clamped in the insertion ports.

4. The pond water pump according to claim 3, wherein the mounting rack comprises an upper mounting part and a lower mounting part; the upper mounting part and the lower mounting part can be spliced and connected; and when the upper mounting part and the lower mounting part are spliced, the second mounting groove is formed.

5. The pond water pump according to claim 4, wherein the clamping blocks comprise a first clamping block and a second clamping block; the first clamping block is arranged on an inner side surface of the upper mounting part, and the second clamping block is arranged on an inner side surface of the lower mounting part; the first clamping block is provided with an insertion pin, and the second clamping block is provided with a jack; and when the upper mounting part and the lower mounting part are mounted, the insertion pin is inserted into the jack.

6. The pond water pump according to claim 1, wherein the light-emitting main body comprises a lamp body and a housing; the lamp body is arranged in the housing; light of the lamp body is transmitted through the housing; and the housing seals the lamp body.

7. The pond water pump according to claim 6, wherein a material of the housing is transparent polyvinyl chloride.

8. The pond water pump according to claim 6, wherein the lamp body comprises a flexible circuit board and a light-emitting diode (LED) lamp; and the LED lamp is arranged on the flexible circuit board and is electrically connected to the flexible circuit board.

9. The pond water pump according to claim 6, wherein the pond water pump further comprises an electric wire; a first threading hole is arranged on the filtering mesh; a second threading hole is arranged on the mounting rack; a third threading hole is arranged on the housing; one end of the electric wire is connected to the driving device, and the other end of the electric wire is connected to the lamp body through the first threading hole, the second threading hole, and the third threading hole in sequence; the third threading hole is connected to the electric wire through interference fit; and the electric wire is connected to the first threading hole through interference fit.

10. The pond water pump according to claim 9, wherein the filtering mesh comprises a filtering mesh main body and a wire passing cover; the filtering mesh main body is provided with a mounting port; the wire passing cover is detachably arranged at the mounting port; and the first threading hole is arranged on the wire passing cover.

11. The pond water pump according to claim 9, wherein first water baffle plates are arranged between the filtering mesh and a side wall of the first mounting groove; and the first water baffle plates are located on two sides of the first threading hole.

12. The pond water pump according to claim 11, wherein second water baffle plates are further arranged between the filtering mesh and the side wall of the first mounting groove; and the second water baffle plates are located on a side opposite to the first water baffle plates.

13. A pond water pump, wherein the pond water pump comprises a driving device, a filtering mesh, and a light-emitting device; the light-emitting device and the driving device are both arranged in the filtering mesh; and the light-emitting device is electrically connected to the driving device;

wherein a top of the filtering mesh is provided with a first mounting groove; the driving device is mounted in the first mounting groove; and the light-emitting device is located at a bottom of the first mounting groove;

wherein a ring groove is arranged on an outer side wall of the driving device; the ring groove is arranged around the outer side wall of the driving device; a convex block is arranged at a periphery of an inner side wall of the first mounting groove; the convex block is clamped into the ring groove, so that the driving device is connected to the filtering mesh.

14. The pond water pump according to claim 1, wherein a bottom of the first mounting groove is provided with several first through holes, and a side wall of the first mounting groove is provided with several second through holes.

15. The pond water pump according to claim 1, wherein an outer side wall of the filtering mesh is provided with several third through holes, and the third through holes extend from a top edge of the filtering mesh to a bottom edge of the filtering mesh.

* * * * *